US011133125B2

(12) United States Patent
Choi et al.

(10) Patent No.: US 11,133,125 B2
(45) Date of Patent: Sep. 28, 2021

(54) COIL COMPONENT AND METHOD OF MANUFACTURING THE SAME

(71) Applicant: SAMSUNG ELECTRO-MECHANICS CO., LTD., Suwon-si (KR)

(72) Inventors: Eo Jin Choi, Suwon-si (KR); Jae Hun Kim, Suwon-si (KR)

(73) Assignee: SAMSUNG ELECTRO-MECHANICS CO., LTD., Suwon-si (KR)

( * ) Notice: Subject to any disclaimer, the term of this patent is extended or adjusted under 35 U.S.C. 154(b) by 303 days.

(21) Appl. No.: 16/011,023

(22) Filed: Jun. 18, 2018

(65) Prior Publication Data

US 2019/0198215 A1 Jun. 27, 2019

(30) Foreign Application Priority Data

Dec. 26, 2017 (KR) ..... 10-2017-0179515

(51) Int. Cl.
*H01F 27/29* (2006.01)
*H01F 27/28* (2006.01)
(Continued)

(52) U.S. Cl.
CPC ..... *H01F 17/0013* (2013.01); *H01F 17/0033* (2013.01); *H01F 17/04* (2013.01);
(Continued)

(58) Field of Classification Search
CPC .... H01F 17/0013; H01F 41/046; H01F 17/04; H01F 27/2804; H01F 27/292;
(Continued)

(56) References Cited

U.S. PATENT DOCUMENTS

2005/0136636 A1 6/2005 Shim et al.
2009/0322458 A1* 12/2009 Lee ..... H01F 17/0006 335/299

(Continued)

FOREIGN PATENT DOCUMENTS

CN 101620916 A 1/2010
CN 104733155 A 6/2015

(Continued)

OTHER PUBLICATIONS

Office Action issued in corresponding Korean Patent Application No. 10-2017-0179515 dated Apr. 1, 2019, with English translation.

(Continued)

*Primary Examiner* — Tuyen T Nguyen
(74) *Attorney, Agent, or Firm* — Morgan, Lewis & Bockius LLP

(57) ABSTRACT

A coil component includes a body, and a coil portion embedded in the body and including a coil pattern having a plurality of coil turns and a support member supporting the coil pattern. A height of an internal coil turn of the plurality of coil turns is lower than a height of an external coil turn of the plurality of coil turns connected to the internal coil pattern and wound outwardly of the internal coil turn. A method of manufacturing the coil component includes forming a spiral-shaped plating seed pattern on a support member, forming a cutting portion cutting the spiral-shaped plating pattern, and forming a coil pattern extending across the cutting portion by performing plating on the spiral-shaped plating seed pattern.

11 Claims, 6 Drawing Sheets

(51) Int. Cl.
*H01F 17/00* (2006.01)
*H01F 17/04* (2006.01)
*H01F 41/04* (2006.01)

(52) U.S. Cl.
CPC ..... *H01F 27/28* (2013.01); *H01F 27/2804* (2013.01); *H01F 27/29* (2013.01); *H01F 27/292* (2013.01); *H01F 41/041* (2013.01); *H01F 41/046* (2013.01); *H01F 2017/0073* (2013.01); *H01F 2017/048* (2013.01); *H01F 2027/2809* (2013.01)

(58) Field of Classification Search
CPC ..... H01F 17/0033; H01F 41/041; H01F 2017/048; H01F 2017/0073; H01F 2027/2809; H01F 27/306
See application file for complete search history.

(56) References Cited

U.S. PATENT DOCUMENTS

| | | | | |
|---|---|---|---|---|
| 2013/0222101 | A1* | 8/2013 | Ito | H01F 5/003 336/83 |
| 2015/0170823 | A1 | 6/2015 | Jeong et al. | |
| 2016/0163444 | A1 | 6/2016 | Choi et al. | |
| 2016/0189840 | A1 | 6/2016 | Ahri et al. | |
| 2016/0351316 | A1* | 12/2016 | Ohkubo | H01F 27/325 |
| 2016/0351320 | A1* | 12/2016 | Jeong | H01F 27/292 |
| 2017/0178790 | A1 | 6/2017 | Kim et al. | |
| 2019/0259522 | A1 | 8/2019 | Kim et al. | |

FOREIGN PATENT DOCUMENTS

| | | | |
|---|---|---|---|
| CN | 105448503 | A | 3/2016 |
| CN | 105742035 | A | 7/2016 |
| CN | 106205953 | A | 12/2016 |
| CN | 106783069 | A | 5/2017 |
| CN | 110189886 | A | 8/2019 |
| JP | 2010-16337 | A | 1/2010 |
| JP | 5766432 | B2 | 8/2015 |
| KR | 10-2003-0020603 | A | 3/2003 |
| KR | 10-0555680 | B1 | 6/2005 |
| KR | 10-1525703 | B1 | 6/2015 |
| KR | 10-2017-0073159 | A | 6/2017 |
| KR | 10-2017-0123300 | A | 11/2017 |

OTHER PUBLICATIONS

Office Action issued in corresponding Chinese Patent Application No. 201810921191.3 dated Oct. 12, 2020, with English translation.

* cited by examiner

COIL COMPONENT AND METHOD OF MANUFACTURING THE SAME

CROSS-REFERENCE TO RELATED APPLICATION(S)

This application claims benefit of priority to Korean Patent Application No. 10-2017-0179515 filed on Dec. 26, 2017 in the Korean Intellectual Property Office, the disclosure of which is incorporated herein by reference in its entirety.

BACKGROUND

1. FIELD

The present disclosure relates to a coil component and a method of manufacturing the same.

2. DESCRIPTION OF RELATED ART

In support of the miniaturization and thinning of electronic devices such as digital televisions (TVs), mobile phones, laptop computers, and the like, the miniaturization and thinning of coil components used in such electronic devices have been demanded. In order to satisfy such demand, various types of coil components have been developed.

A main difficulty in the miniaturization and thinning of coil components is the ability to maintain a number of turns of a coil and a cross-sectional area of coil patterns in a miniaturized package, so as to provide a coil component with characteristics equal to characteristics of an existing coil component in spite of the miniaturization and thinning. In order to satisfy such a demand, a method of increasing an aspect ratio of the coil patterns has been researched. In this method, the coil patterns may be formed by a plating process. However, as an intended aspect ratio of the coil patterns is increased, it is more likely that a height deviation between the coil patterns depending on a difference in speeds of plating growth will be generated. Therefore, a need exists for a technology for accurately controlling heights of the coil patterns in the plating process.

SUMMARY

An aspect of the present disclosure may provide a method of manufacturing a coil component capable of controlling heights of coil patterns depending on plating growth with respect to specific portions of the coil patterns, and a coil component having improved reliability and magnetic characteristics.

According to an aspect of the present disclosure, a coil component may include a body having a coil portion embedded therein. The coil portion includes a coil pattern having a plurality of coil turns and a support member supporting the coil pattern. A height of an internal coil turn of the plurality of coil turns is lower a height of an external coil turn of the plurality of coil turns connected to the internal coil pattern and wound outwardly of the internal coil turn.

According to another aspect of the present disclosure, a method of manufacturing a coil component including a body having a coil portion embedded therein may include forming a spiral-shaped plating seed pattern on at least one surface of a support member. At least one cutting portion cutting the spiral-shaped plating seed pattern is formed, and pattern walls are formed on both sides of the spiral-shaped plating seed pattern. A coil pattern extending between the pattern walls is formed by a plating process using the spiral-shaped plating seed pattern.

According to a further aspect of the present disclosure, a method of manufacturing a coil component may include forming first and second plating seed patterns on a surface of a support member, where the first and second plating seed patterns are spaced apart from each other by a cutting portion. A first plating layer is formed on the first plating seed pattern only by performing a first plating process using the first plating seed pattern only from among the first and second plating seed patterns. Following the forming of the first plating layer, a second plating layer is formed on the first and second plating seed patterns by performing a second plating process using the first and second plating seed patterns.

BRIEF DESCRIPTION OF DRAWINGS

The above and other aspects, features, and advantages of the present disclosure will be more clearly understood from the following detailed description taken in conjunction with the accompanying drawings, in which.

DETAILED DESCRIPTION

Hereinafter, exemplary embodiments will now be described in detail with reference to the accompanying drawings.

Figure 1:
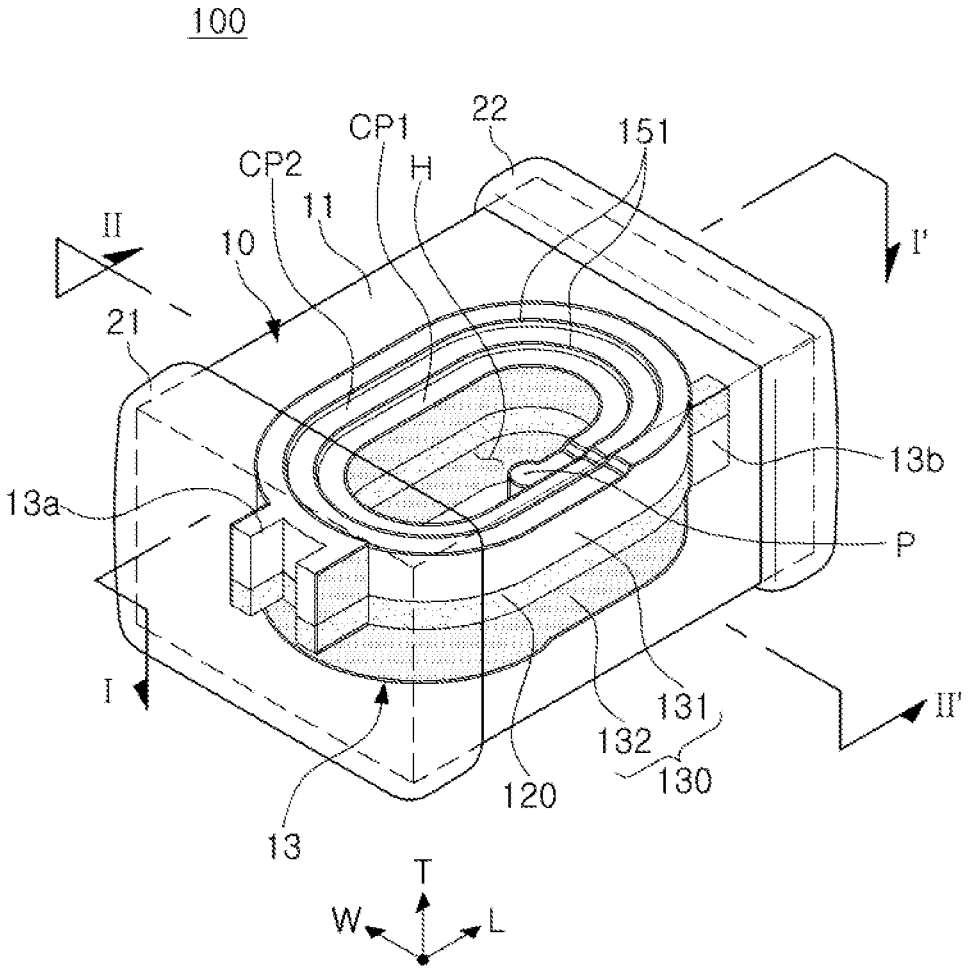
FIG. 1 is a schematic perspective view illustrating a coil component according to an exemplary embodiment.
Figure 2:
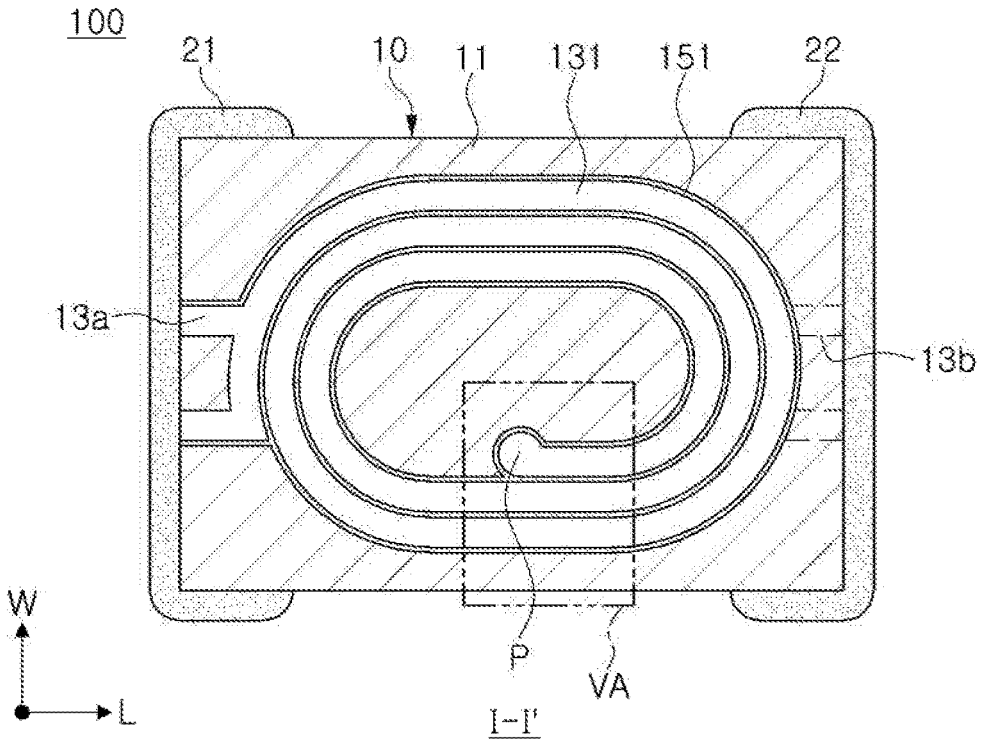
FIG. 2 is a cross-sectional view taken along line I-I' of the coil component of FIG. 1.
Figure 3:
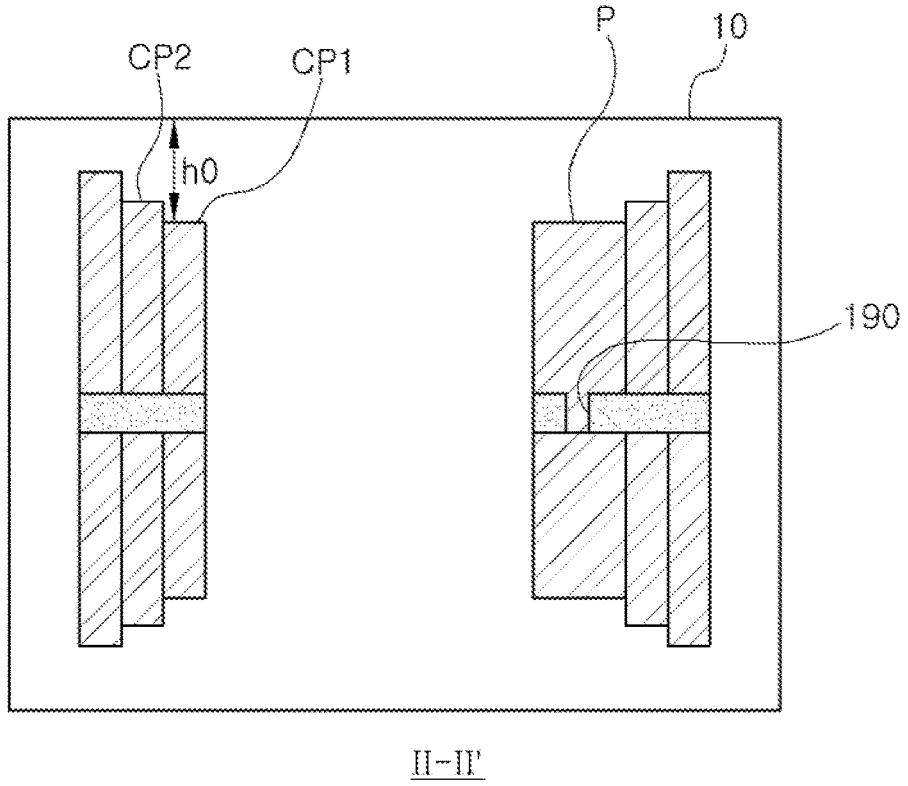
FIG. 3 is a cross-sectional view taken along line II-II' of the coil component of FIG. 1.

FIG. 1 is a schematic perspective view illustrating a coil component according to an exemplary embodiment, FIG. 2 is a cross-sectional view taken along line I-I' of the coil component of FIG. 1, and FIG. 3 is a cross-sectional view taken along line II-II' of the coil component of FIG. 1.

Referring to FIGS. 1 through 3, a coil component 100 according to an exemplary embodiment may include a body 10, a coil portion 13, and first and second external electrodes 21 and 22.

The body 10 may constitute an outer appearance of the coil component, and have an upper surface and a lower surface opposing each other in a thickness direction T, a first end surface and a second end surface opposing each other in a length direction L, and a first side surface and a second side surface opposing each other in a width direction W to thus have a substantially hexahedral shape, but is not limited thereto.

The first and second external electrodes 21 and 22 may be disposed on external surfaces of the body 10. A case in which the first and second external electrodes 21 and 22 have a "C" shape is illustrated, but the first and second external electrodes 21 and 22 may have any shape as long as they may be electrically connected to the coil portion 13 embedded in the body 10. In addition, the first and second external electrodes 21 and 22 may be formed of a conductive material. In detail, the first external electrode 21 may be connected to a first lead portion 13*a* of one end portion of the coil portion 13, and the second external electrode 22 may be connected to a second lead portion 13*b* of the other end portion of the coil portion 13. Therefore, the first and second external electrodes 21 and 22 may electrically connect opposing end portions of the coil portion 13 to an external electrical component (for example, pads of a board).

The body 10 may include a magnetic material 11. For example, the body 10 may be formed of ferrite or a metal based soft magnetic material. The ferrite may include any known ferrite such as Mn—Zn based ferrite, Ni—Zn based ferrite, Ni—Zn—Cu based ferrite, Mn—Mg based ferrite, Ba based ferrite, Li based ferrite, or the like. In addition, the metal based soft magnetic material may be an alloy including one or more selected from the group consisting of Fe, Si, Cr, Al, and Ni. For example, the metal based soft magnetic material may include Fe—Si—B—Cr based amorphous metal particles, but is not limited thereto. The metal based soft magnetic material may have a particle diameter of 0.1 μm or more to 20 μm or less, and may be included in a polymer such as an epoxy resin, polyimide, or the like, in a form in which it is dispersed on the polymer.

The coil portion 13 may be encapsulated in the body 10 by the magnetic material 11. In addition, the coil portion 13 may include one or more coil pattern(s) 130 and a support member 120 supporting the coil pattern(s) 130.

As illustrated in FIGS. 1 and 3, the coil pattern(s) 130 may include first and second coil patterns 131 and 132 disposed on opposite surfaces of the support member 120, respectively. That is, the first coil pattern 131 may be formed on one surface of the support member 120, and the second coil pattern 132 may be formed on the other surface of the support member 120 opposing the one surface of the support member 120.

The support member 120 may serve to support the coil pattern(s) 130, and may serve to allow an internal coil to be easily formed. The support member 120 may be formed of any material having an insulation property and having a thin film form, such as a copper clad laminate (CCL) substrate, an insulating film such as an Ajinomoto build-up film (ABF), or the like. A certain thickness of the support member 120 may be thin in accordance with the trend toward miniaturization of electronic products, but is preferably sufficient to appropriately support the coil pattern(s) 130 and may thus be, for example, about 60 μm. In addition, a through-hole H may be formed at the center of the support member 120. The through-hole H may be filled with the magnetic material 11, such that an entire magnetic permeability of the coil component 100 may be improved. In addition, a via hole 190 may extend through the support member 120 at a position spaced apart from the through-hole H of the support member 120 by a predetermined interval. Since the via hole 190 is filled with a conductive material of the via portion P, the first coil pattern 131 and the second coil pattern 132 disposed on upper and lower surfaces of the support member 120, respectively, may be physically and electrically connected to each other through a via portion P.

The first coil pattern 131 will hereinafter be mainly described for convenience of explanation, but described features of the first coil pattern 131 may equally apply to the second coil pattern 132.

The first coil pattern 131 may have a plurality of turns. For example, the first coil pattern 131 may be wound in a spiral shape, and may have a number of turns appropriately selected depending on a design.

In addition, the first coil pattern 131 may include an internal coil pattern CP1 and an external coil pattern CP2. The internal coil pattern CP1 may be a portion of the first coil pattern 131 corresponding to an internal coil turn of the plurality of coil turns, and the external coil pattern CP2 may be a portion of the first coil pattern 131 corresponding to an external coil turn of the plurality of coil turns connected to the internal coil pattern and extending outwardly of the internal coil turn. In the exemplary embodiment, the internal coil pattern CP1 may be formed to have a height lower than that of the external coil pattern CP2 (e.g., a height measured orthogonally to a surface of the support member 120 on which the first coil pattern 131 is disposed). That is, the first coil pattern 131 having the plurality of coil turns may have coil turns with different heights in an extension direction. Further, the first coil pattern 131 may be formed so that a height thereof is stepwise increased from an inner portion of the coil portion 13 to an outer portion of the coil portion 13.

In addition, as illustrated in FIG. 3, the first coil pattern 131 may have a shape in which the height is stepwise increased from the via portion P to the outermost coil turn. In such a shape, a thick margin h0 (e.g., between an upper external surface of the body 10 and an upper surface of the coil pattern) may be secured by the internal coil pattern CP1 having a height relatively lower than that of the external coil pattern CP2. The thick margin h0 may prevent damage to the body 10 of the coil component to improve reliability of the coil component.

Meanwhile, a case in which the via portion P has a height lower than that of the internal coil pattern CP1 is illustrated in FIG. 3, but the via portion P may have a height that is the same as that of the internal coil pattern CP1.

The first coil pattern 131 may be formed by plating growth by an electroplating process, and may include a metal having excellent electrical conductivity. For example, the first coil pattern 131 may be formed of silver (Ag), palladium (Pd), aluminum (Al), nickel (Ni), titanium (Ti), gold (Au), copper (Cu), platinum (Pt), or alloys thereof, but is not limited thereto.

In addition, the coil portion 13 may further include pattern walls 151 . The first coil pattern 131 may extend between the pattern walls 151 on the support member 120. Each pattern wall 151 may be disposed between adjacent windings of each of the coil pattern(s) 130. Since the pattern walls 151 may be utilized as a plating growth guide for forming the first coil pattern 131, when the pattern walls 151 are used, a shape of the first coil pattern 131 may be easily controlled. For example, the first coil pattern 131 formed using the pattern walls 151 may have a high aspect ratio. The pattern walls 151 may be formed of a photosensitive resin in which one photo acid generator (PAG) and several epoxy based resins are combined with each other, and one kind of epoxy or one or more kinds of epoxy may be used. In addition, the pattern walls 151 may be filled with an insulating material filled after the photosensitive resin is removed. In detail, when the first coil 131 pattern is formed, the photosensitive resin may be removed by striping by a stripping solution, laser etching, or the like, and the pattern walls 151 may be formed of the insulating material such as a composite resin, or the like, filled in spaces in which the photosensitive resin is removed.

Figure 4:
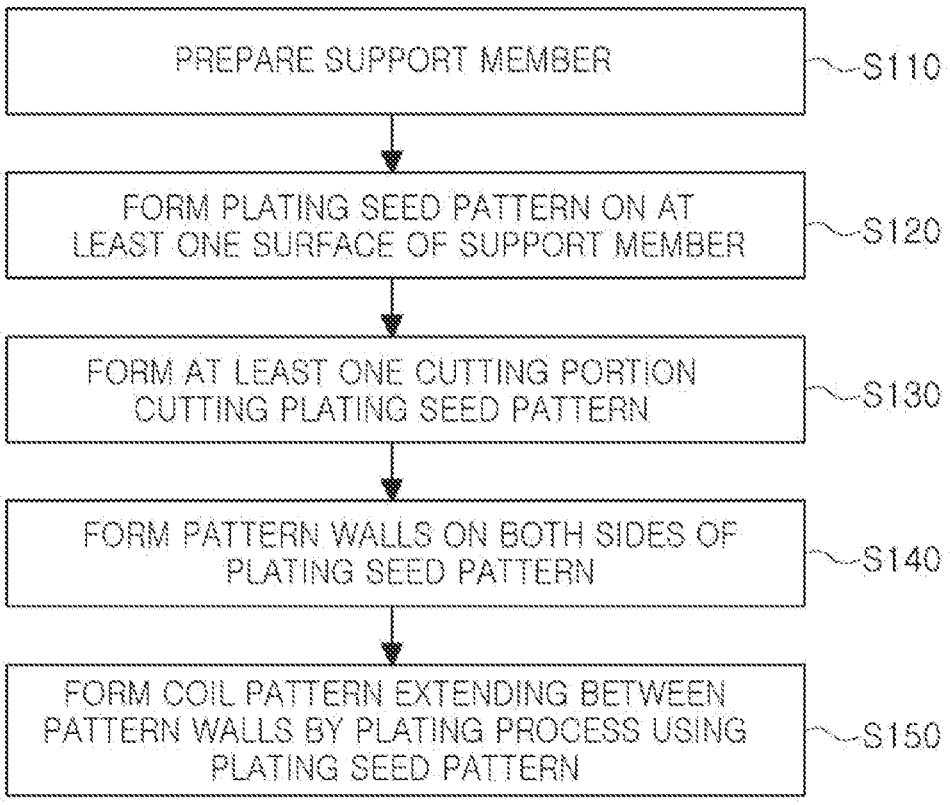
FIG. 4 is a flow chart illustrating a method of manufacturing a coil component according to an exemplary embodiment.

FIG. 4 is a flow chart illustrating a method of manufacturing a coil component according to an exemplary embodiment.

First, a support member may be prepared (S110), and a plating seed pattern may be formed on at least one surface of the support member (S120). The plating seed pattern may be formed by any known method. For example, a plating seed layer may be formed on the support member by chemical vapor deposition (CVD), physical vapor deposition (PVD), sputtering, or the like, using a dry film, or the like, and the plating seed layer except for the plating seed pattern may be removed by an etching process using a mask pattern. Then, the mask pattern may be removed by an appropriate asking process or etching process.

Then, at least one cutting portion cutting the plating seed pattern may be formed (S130). The cutting portion refers to a region in which the plating seed pattern is removed by a predetermined length in a predetermined position.

Then, pattern walls may be formed on both sides of the plating seed pattern (S140), and the coil pattern extending between the pattern walls may be formed by a plating process using the plating seed pattern (S150).

The plating process using the plating seed pattern and the cutting portion will hereinafter be described in detail with reference to FIGS. 5 through 9.

Figure 5:
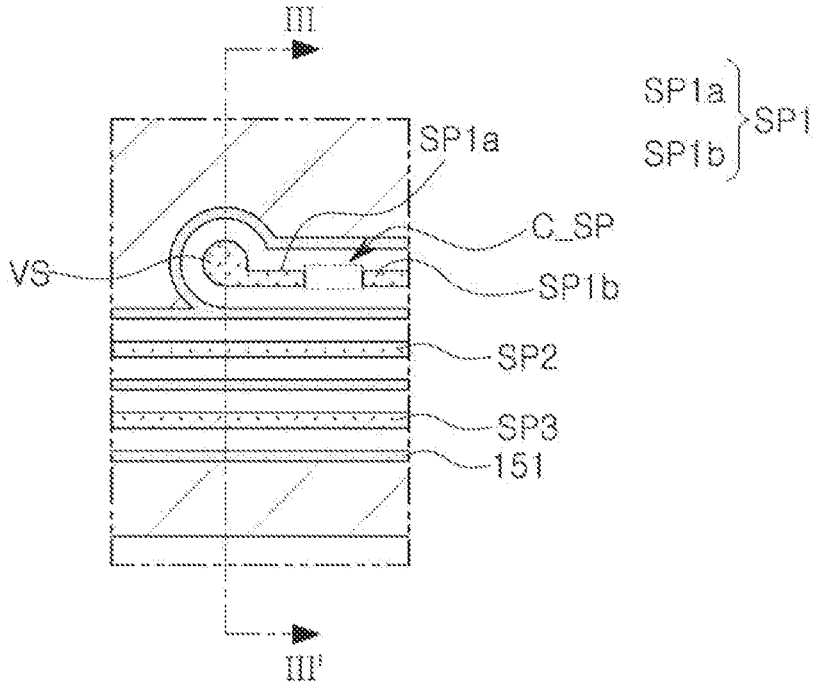
FIG. 5 is a planar view for describing the method of manufacturing a coil component according to an exemplary embodiment.
Figures 6A, 6B, 6C, 6D:
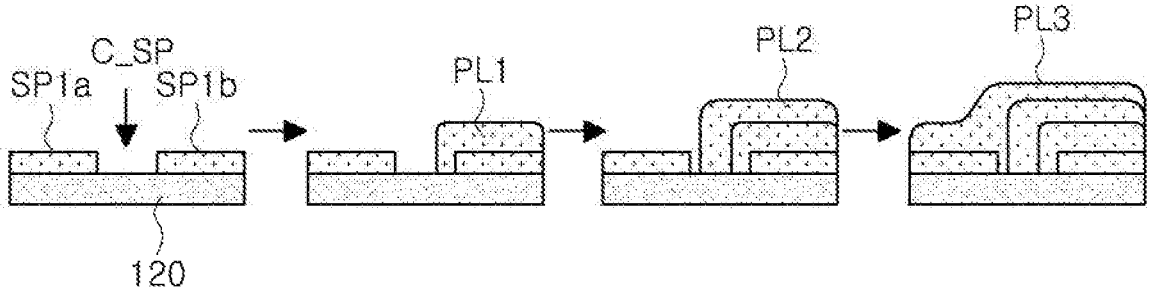
FIGS. 6A through 6D are views illustrating plating growth in a cutting portion according to an exemplary embodiment.
Figure 7:
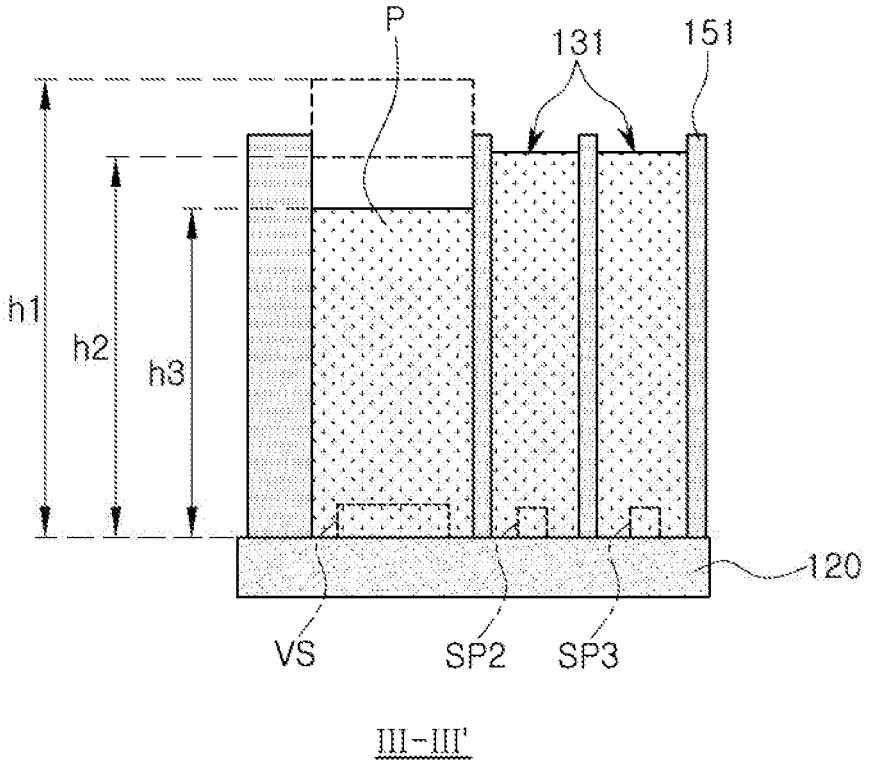
FIG. 7 is a cross-sectional view taken along line of the coil component of FIG. 5.

FIG. 5 is a view for describing the method of manufacturing a coil component according to an exemplary embodiment, FIGS. 6A through 6D are views for describing plating growth in a cutting portion according to an exemplary embodiment, and FIG. 7 is a cross-sectional view taken along line of the coil component of FIG. 5.

In detail, FIG. 5 illustrates region VA of FIG. 2, and illustrates a state in which plating growth is not performed, FIGS. 6A through 6D illustrate a state in which the plating growth is being performed, and FIG. 7 illustrates a state in which the plating growth is completed.

Referring to FIG. 5, a via seed VS for forming the via portion and first to third plating seed patterns SP1, SP2, and SP3 for forming the coil pattern may be provided. In addition, the pattern walls 151 may be disposed to surround the via seed VS and the first to third plating seed patterns SP1, SP2, and SP3.

A cutting portion C_SP may be disposed in a predetermined position of the plating seed pattern (e.g., in a predetermined position of at least one of the first to third plating seed patterns SP1, SP2, and SP3). For example, the cutting portion C_SP may be disposed adjacent to the via seed VS to be adjacent to the via portion. That is, as illustrated in FIG. 5, the cutting portion C_SP may be disposed to separate the first plating seed pattern SP1 into a plating seed pattern SP1*a* connected to the via seed VS and a plating seed pattern SP1*b* on the other side of the cutting portion C_SP. The cutting portion C_SP may correspond to a gap in the plating seed pattern that separates and electrically isolates one portion of the plating seed pattern (e.g., disposed on one side of the cutting portion) from another portion of the plating seed pattern (e.g., disposed on another side of the cutting portion). The cutting portion C_SP may control heights of the coil patterns disposed on both sides of the cutting portion C_SP and the via portion.

Such a height control mechanism will be described in detail with reference to FIGS. 6A through 6D.

Referring to FIG. 6A, the cutting portion C_SP may separate the plating seed pattern into a left plating seed pattern SP1*a* and a right plating seed pattern SP1*b*. When a plating process is performed, a current may be applied to the right plating seed pattern SP1*b*, and as illustrated in FIGS. 6B and 6C, first and second plating layers PL1 and PL2 may be formed on the right plating seed pattern SP1*b*. Then, referring to FIG. 6D, a grown plating layer may connect the left plating seed pattern SP1*a* and the right plating seed pattern SP1*b* to each other, and when a current is applied to the left plating seed pattern SP1*a*, a third plating layer PL3 may be grown on the right and left plating seed patterns SP1*a* and SP1*b*.

As described above, in the plating process, the cutting portion C_SP may allow plating growth for the plating seed pattern disposed on one side of the cutting portion C_SP to start later than that for the plating seed pattern disposed at the other side of the cutting portion C_SP. Therefore, the coil patterns formed by the plating growth may have different heights in front of and behind the cutting portion C_SP in an extension direction.

A time interval between the plating growth starting in front of and behind the cutting portion C_SP may be controlled depending on a length of the cutting portion C_SP in the extension direction of the plating seed pattern, and a difference in heights between the coil patterns disposed on both sides of the cutting portion C_SP may thus be controlled depending on a length of the cutting portion C_SP.

Referring to FIG. 7, it may be confirmed that a height h2 of the coil patterns 131 formed outside the via portion P is higher than a height h3 of the via portion plating-grown on the via seed disposed on one side of the cutting portion C_SP (see FIG. 5).

Since a width of the via portion P is greater than that of the coil patterns 131, plating growth may be more rapidly performed in the via portion P in the plating process, such that a phenomenon in which the via portion P is formed at a height h1 higher than the height h2 of the coil patterns 131 may occur.

In the method of manufacturing a coil component according to an exemplary embodiment, the cutting portion C_SP (see FIG. 5) is disposed adjacent to the via seed VS, and plating growth for the via seed VS may thus start later than that for the second and third plating seed patterns SP2 and SP3. Therefore, the via portion P may be formed to have a height h2 that is the same as that of the coil patterns 131 or a height h3 that is lower than that of the coil patterns 131.

Figure 8:
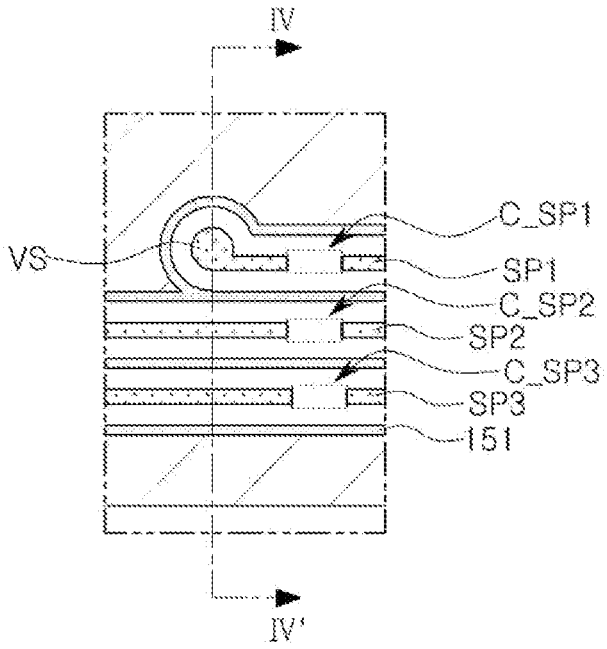
FIG. 8 is a view for describing a method of manufacturing a coil component according to another exemplary embodiment.
Figure 9:
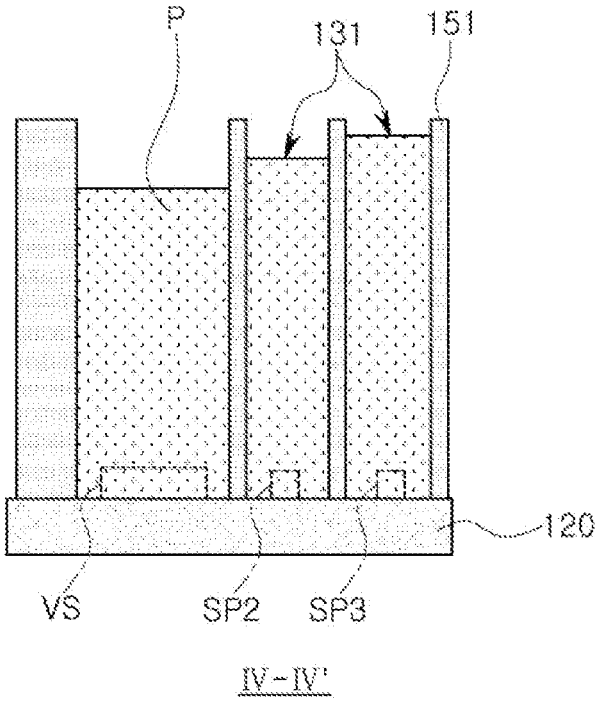
FIG. 9 is a cross-sectional view taken along line IV-IV' of the coil component of FIG. 8.

FIG. 8 is a view for describing a method of manufacturing a coil component according to another exemplary embodiment, and FIG. 9 is a cross-sectional view taken along line IV-IV' of the coil component of FIG. 8.

In detail, FIG. 8 illustrates region VA of FIG. 2, and illustrates a state in which plating growth is not performed, and FIG. 9 illustrates a state in which the plating growth is completed.

Referring to FIG. 8, similarly to what was described above with reference to FIG. 5, a via seed VS, first to third plating seed patterns SP1, SP2, and SP3, and pattern walls 151 may be provided.

In addition, a plurality of cutting portions C_SP1, C_SP2, and C_SP3 may be disposed at a plurality of positions of the plating seed patterns. For example, a first cutting portion C_SP1 may be disposed in a first plating seed pattern SP1, a second cutting portion C_SP2 may be disposed in a second plating seed pattern SP2, and a third cutting portion C_SP3 may be disposed in a third plating seed pattern SP3.

Referring to FIG. 9, plating growth for the third plating seed pattern SP3 may first start, plating growth for the second plating seed pattern SP2 may start after a predetermined time, and plating growth for the via seed VS may finally start by the first to third cutting portions C_SP1, C_SP2, and C_SP3 described above. Therefore, a via portion P and coil patterns 131 may have heights that are stepwise increased from the via portion to the outermost coil pattern.

Figure 10A:
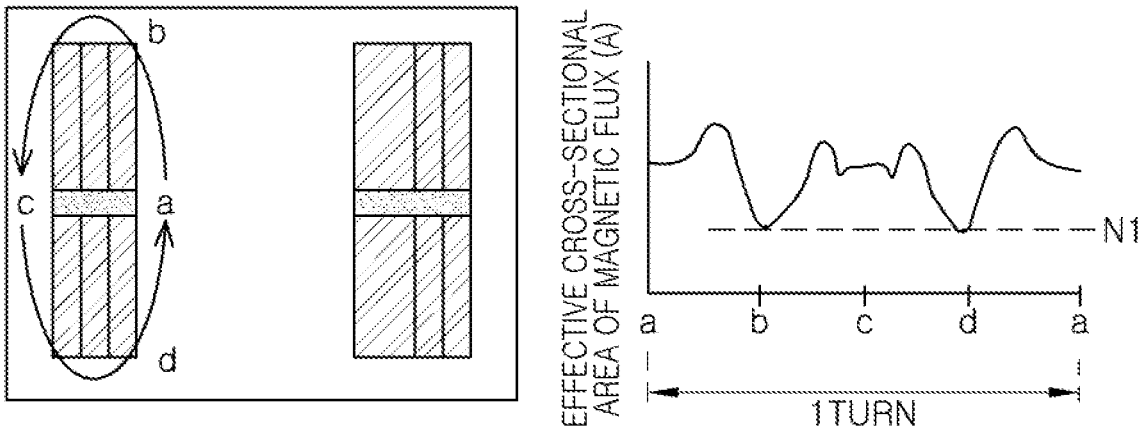
FIGS. 10A and 10B are plots illustrating magnetic characteristics of the coil component according to an exemplary embodiment.
Figure 10B:
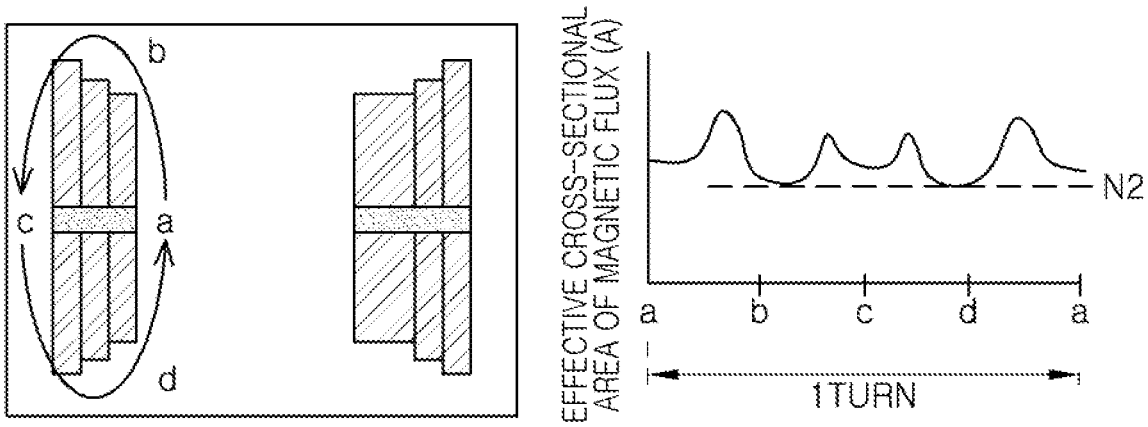

FIGS. 10A and 10B are views for describing magnetic characteristics of the coil component according to an exemplary embodiment.

As an aspect ratio of the coil pattern becomes large and a thickness of the coil component becomes thin, a margin between an external surface (e.g., upper surface) of the coil component and an external surface (e.g., upper surface) of the coil pattern may be decreased. The margin may determine an effective cross-sectional area A of a magnetic flux in a magnetic path. When it is assumed that magnetic powders are distributed at a uniform density in the body, an effective cross-sectional area A of a magnetic flux may be in proportion to the magnetic flux, and when the effective cross-sectional area of the magnetic flux is small, a magnetic flux neck phenomenon in which the magnetic flux becomes weak may occur.

Referring to FIG. 10A, a cross section of the coil component and a graph illustrating an effective cross-sectional area of a magnetic flux along a magnetic path formed in the vicinity of the coil portion are shown. In the graph, in regions b and d of the coil component, the effective cross-sectional area of the magnetic flux has a low level N1, and the magnetic flux neck may thus be caused in the coil component.

Referring to FIG. 10B, the internal (or central) coil pattern has a height lower than that of the external (or peripheral) coil pattern, and the margin between the external surface of the coil component and the coil pattern may thus be secured. Therefore, in regions b and d of the coil component, the effective cross-sectional area of the magnetic flux may have an improved level N2. Therefore, in the coil component according to the exemplary embodiment, the magnetic flux neck may be alleviated, and magnetic characteristics may be improved.

As set forth above, in the coil component according to the exemplary embodiment, the height of the coil patterns may be controlled, such that the magnetic flux neck may be alleviated and the magnetic characteristics may be improved.

In addition, according to the exemplary embodiment, the method of manufacturing a coil component capable of controlling heights of coil patterns depending on plating growth with respect to specific portions of the coil patterns may be provided.

While exemplary embodiments have been shown and described above, it will be apparent to those skilled in the art that modifications and variations could be made without departing from the scope of the present invention as defined by the appended claims.

What is claimed is:

1. A coil component comprising:

a body; and a coil portion embedded in the body and including a coil pattern extending in an extension direction and having a plurality of coil turns and a support member supporting the coil pattern, wherein a height of an internal coil turn of the plurality of coil turns is lower than a height of an external coil turn of the plurality of coil turns connected to the internal coil turn and wound outwardly of the internal coil turn, and wherein a portion of the coil pattern includes a seed pattern having a cutting portion in which the external coil turn is disposed, the cutting portion extending in the extension direction.

2. The coil component of claim 1, wherein the coil portion includes a plurality of coil patterns including the coil pattern, and the plurality of coil patterns are disposed on opposing surfaces of the support member.

3. The coil component of claim 2, wherein the coil portion further includes a via portion connecting the coil patterns disposed on the opposing surfaces of the support member to each other.

4. The coil component of claim 3, wherein the via portion is connected to the internal coil turn, and has a height that is the same as or lower than that of the internal coil turn.

5. The coil component of claim 1, wherein the coil pattern has a height that is stepwise increased from an innermost coil turn to an outermost coil turn of the plurality of coil turns.

6. A coil component comprising:

a body; and a coil portion embedded in the body and including a coil pattern having a plurality of coil turns and a support member supporting the coil pattern, wherein a height of an internal coil turn of the plurality of coil turns is lower than a height of an external coil turn of the plurality of coil turns connected to the internal coil turn and wound outwardly of the internal coil turn, and wherein the coil pattern is formed by plating growth using a seed pattern, and an internal seed pattern for the internal coil turn and an external seed pattern for the external coil turn are disconnected from each other.

7. A coil component comprising:

a support member; and a plating seed pattern disposed on a surface of the support member and having a coil shape extending in a winding direction to have a plurality of windings, wherein the plating seed pattern comprises a plurality of segments in at least one of the plurality of windings that are spaced apart and isolated from each other by one or more cutting portions in the winding direction.

8. The coil component of claim 7 further comprising:

a pattern wall disposed on the surface of the support member between adjacent windings of the plurality of windings of the plating seed pattern.

9. The coil component of claim 7, wherein the plurality of segments of the plating seed pattern comprises a first segment and a second segment jointly forming at least one winding of the coil shape and spaced apart by a first cutting portion.

10. The coil component of claim 9, further comprising:

a plating layer disposed on the first and second segments of the plating seed pattern and on the first cutting portion, wherein the plating layer has a lower height on the first segment than on the second segment of the plating seed pattern.

11. The coil component of claim 10, wherein the first segment is disposed closer to a center of the coil pattern than the second segment.

* * * * *